United States Patent [19]

Watanabe

[11] Patent Number: 4,828,519

[45] Date of Patent: May 9, 1989

[54] OUTBOARD MOTORS

[75] Inventor: Eifu Watanabe, Hamamatsu, Japan

[73] Assignee: Sanshin Kogyo Kabushiki Kaisha, Hamamatsu, Japan

[21] Appl. No.: 541,136

[22] Filed: Oct. 12, 1983

[30] Foreign Application Priority Data

Oct. 13, 1982 [JP] Japan ..... 57-178452

[51] Int. Cl.[4] ..... B63H 21/10

[52] U.S. Cl. ..... 440/88; 440/49

[58] Field of Search ..... 440/88, 49; 184/6.2, 184/6.5, 6.6, 103 R; 123/195 C, 196 R, 196 W

[56] References Cited

U.S. PATENT DOCUMENTS

| | | | |
|---|---|---|---|
| 1,286,345 | 12/1918 | Kirkham | 184/6.2 |
| 1,447,788 | 3/1923 | Kirkham | 184/6.2 |
| 1,878,224 | 9/1932 | Woolsoli | 184/6.2 |
| 2,346,148 | 4/1944 | Bosnia | 184/6.2 |
| 3,653,464 | 4/1972 | Jacobsen | 184/6.2 |
| 3,805,920 | 4/1974 | Bensinger | 184/6.2 |

*Primary Examiner*—Joseph F. Peters, Jr.
*Assistant Examiner*—Clifford T. Bartz
*Attorney, Agent, or Firm*—Ernest A. Beutler

[57] ABSTRACT

An improved lubricating system for the internal combustion engine of an outboard motor. A lubricant sump is positioned beneath the engine and oil is returned to the sump through a drain opening in a spacer plate that separates the engine from the drive shaft housing. The oil sump and drain opening are configured so that oil will not return from the sump through the drain opening to the engine when the outboard motor is laid on its side edge.

17 Claims, 4 Drawing Sheets

OUTBOARD MOTORS

BACKGROUND OF THE INVENTION

This invention relates to an outboard motor and more particularly to an improved lubricating system for an outboard motor.

As is well known, most outboard motors employ as their power plants, two-cycle internal combustion engines. One reason why a four-cycle engine is not normally employed in connection with outboard motors is the difficulty in providing an adequate lubricant sump with such motors. As a somewhat related problem, when a four-cycle engine is employed with a separate lubricating sump, problems can arise due to the fact that the motor is frequently inclined from its normal running position. That is, the motor may be tilted up when not in use or may be carried or laid on its side when not attached to a watercraft. When the motor is oriented in such extreme conditions, the oil is likely to flow back from the sump into the internal components of the engine and can cause damage. For example, the oil may flow back into the crank chamber of the engine or into the camshaft chamber where it can eventually leak into the combustion chambers past either the valves or the pistons. As a result, upon restarting of the engine, there can be considerable damage and furthermore it can cause pollution, particularly if the oil again drains back out of the engine through its exhaust system.

It is, therefore, a principal object of this invention to provide an improved outboard motor construction.

It is another object of this invention to provide an outboard motor having an improved lubricant sump arrangement that prevents draining back of the oil from the sump to the engine when the motor is in other than a normal running condition.

It is yet a further object of this invention to provide an improved four-cycle engine and lubricant sump therefor that prevents oil from returning into the engine from the sump when the engine is other than in its normal condition.

SUMMARY OF THE INVENTION

A first feature of this invention is adapted to be embodied in an outboard motor having a power head containing an internal combustion engine and having an oil sump positioned beneath the engine. A drain opening communicates the engine with the sump for return of lubricant from the engine to the sump. In accordance with this feature of the invention, the drain opening is sized and located to prevent return of oil from the sump to the engine through the drain opening when the motor is disposed in a condition other than its normal running condition.

Another feature of this invention is adapted to be embodied in a motor having an internal combustion engine, an oil sump positioned beneath the engine, a drive shaft normally driven by the engine and extending in a vertical direction when the motor is in its normal position, and a drain opening communicating the engine with the sump for return of lubricant from the engine to the sump. In accordance with this feature of the invention, the drain opening is sized and located to prevent the return of oil from the sump to the engine when the drive shaft is disposed in a horizontal condition.

A still further feature of this invention is adapted to be embodied in a lubricating system for a four-cycle internal combustion engine that is designed to normally operate with its crankshaft extending in a vertical direction. An oil sump is positioned beneath the engine and a drain opening communicates the engine with the oil sump for return of lubricant from the engine to the sump. In accordance with this feature of the invention, the drain opening is sized and located to prevent return of the oil from the sump to the engine through the drain opening when the crankshaft is oriented in a horizontal direction.

DETAILED DESCRIPTION OF THE PREFERRED EMBODIMENT OF THE INVENTION

Figure 1:
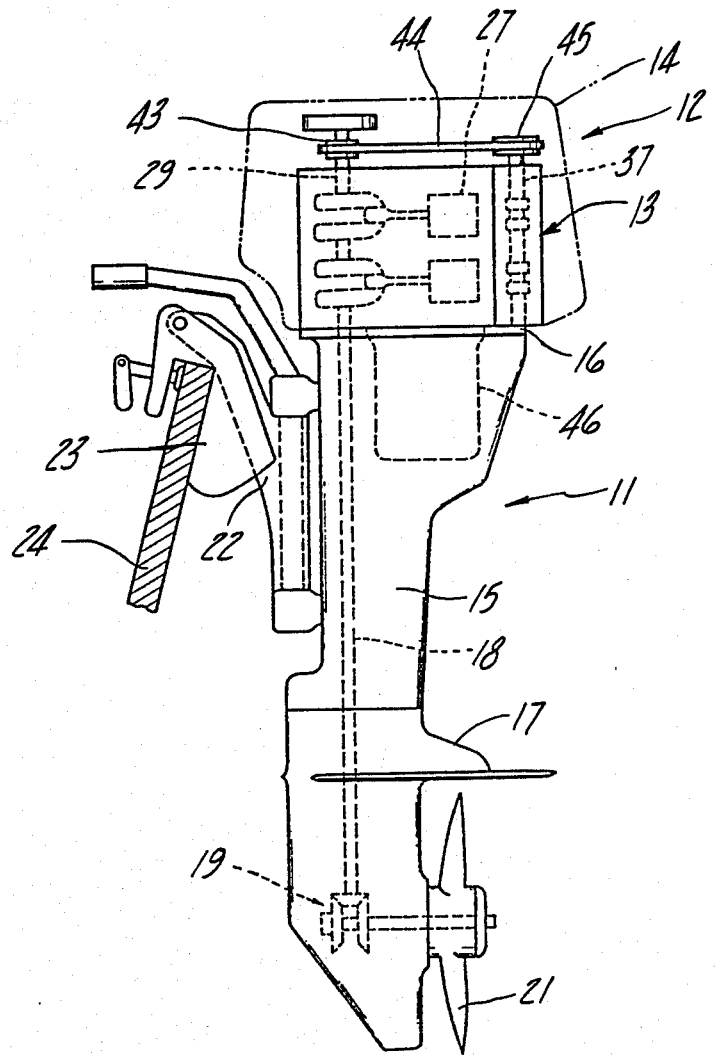
FIG. 1 is a side elevational view of an outboard motor constructed in accordance with the invention and affixed to a transom of an associated watercraft, which transom is shown in cross-section.

Referring first to FIG. 1, an outboard motor constructed in accordance with an embodiment of the invention is identified generally by the reference numeral 11. The outboard motor 11 includes a power head, indicated generally by the reference numeral 12, containing an internal combustion engine 13 and surrounded by a protective cowling, which is shown in phantom and is identified by the reference numeral 14. The power head 12 is connected to the upper end of a drive shaft housing 15 by means including a spacer plate 16. At the lower end of the drive shaft housing 15, there is formed a lower unit 17. A drive shaft 18 depends from the power head 12, through the drive shaft housing 15 and terminates in the lower unit 17. The drive shaft 18 drives a forward, neutral, reverse transmission 19 that is operative in a known manner so as to drive a propeller 21 that is journalled in the lower unit 17. The outboard motor 11 and specifically the drive shaft housing 15 is supported for steering movement about a vertically extending axis, in a known manner, by means including a swivel bracket 22. The swivel bracket 22 is, in turn, pivotally connected to a clamping bracket 23 for movement about a horizontally extending tilt axis. The clamping bracket 23 is adapted to be affixed to a transom 24 of an associated watercraft in a known manner. The construction of the motor 11 as thus far described may be considered to be conventional.

Figure 2:
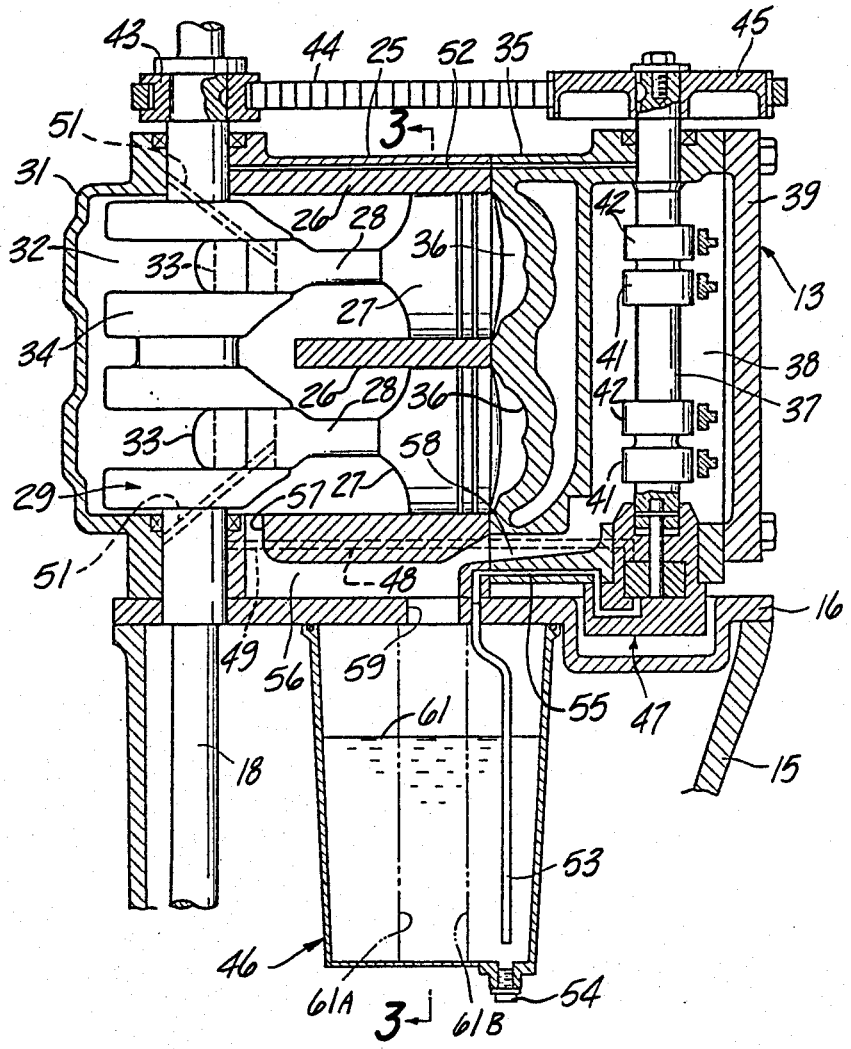
FIG. 2 is an enlarged, cross-sectional view taken through the axis of the crankshaft of the engine of the outboard motor.
Figure 3:
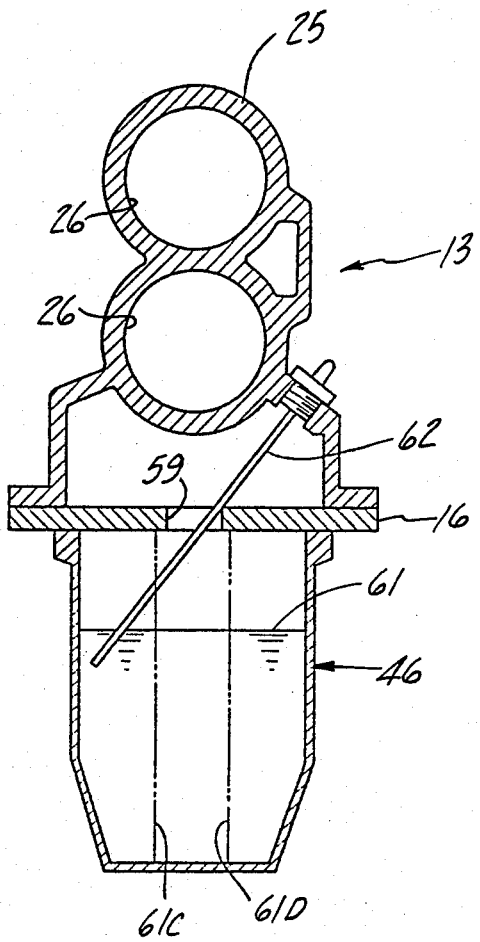
FIG. 3 is a cross-sectional view taken along the line 3—3 of FIG. 2.
Figure 4:
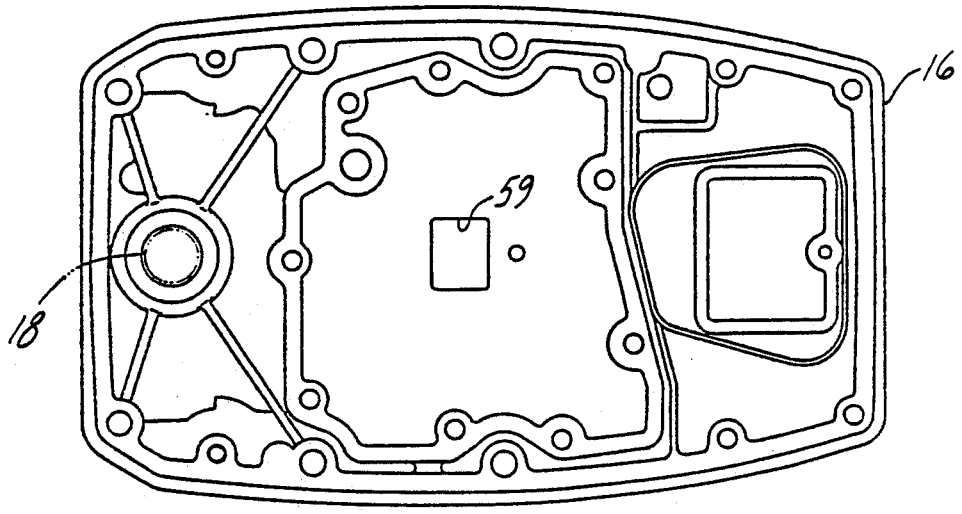
FIG. 4 is an enlarged, top plan view of a spacer plate of the motor.

Referring now additionally to FIGS. 2 and 3, the engine 13 is, in accordance with the invention, of the four-cycle type. The engine 13 includes a cylinder block 25 in which a pair of vertically disposed cylinder bores 26 are formed. In the illustrated embodiment, the engine 13 is of the two-cylinder inline type. It is to be understood, however, that the invention may be utilized in conjunction with engines of other cylinder numbers, other cylinder dispositions, such as V-type engines, or with engines operating on the four stroke principle but of other types such as rotary engines.

Pistons 27 are supported for reciprocation within the cylinder bores 26 and are connected by means of connecting rods 28 to a crankshaft 29 which is supported for rotation about a vertically extending axis. The rotational support for the crankshaft 29 is provided between the cylinder block 25 and a crankcase 31 that is affixed to the cylinder block 25 and which defines a crank chamber 32 in which the crankshaft 29 rotates. The connecting rod lower ends 33 are journalled on throws 34 of the crankshaft 29 in a known manner.

A cylinder head 35 is affixed to the cylinder block 25 at the side opposite the crankcase 31 in a known manner. The cylinder head 35 has recesses 36 that cooperate with the pistons 27 and cylinders 26 so as to form the combustion chambers. One or more spark plugs (not shown) are supported by the cylinder head 35 and have their electrodes disposed within the combustion chambers 36 for firing the charge therein in a known manner.

A camshaft 37 is journalled for rotation about an axis parallel to the axis of rotation of the crankshaft 29 within a cam chamber 38 formed at the upper end of the cylinder head 35. The cam chamber 38 is closed by a cover plate 39 which is, in turn, affixed to the cylinder head 35 in any suitable manner. The camshaft 37 is formed with pairs of lobes 41, 42. The cam lobes 41, 42 are associated with each cylinder 26 and operate intake and exhaust valves (not shown) in any suitable manner so as to admit a charge to the chambers 36 and so as to exhaust the burnt charge from these chambers.

A pulley or sprocket 43 is affixed to the upper end of the crankshaft 29 and drives a toothed belt 44 which, in turn, drives a driven pulley or sprocket 45 that is affixed to the upper end of the camshaft 37 so as to drive the camshaft 37 in timed relationship to the crankshaft 29. As is well known with the four-cycle type of engine, the camshaft 37 is driven at one-half crankshaft speed.

The engine 13 is affixed in a suitable manner to the upper side of the spacer plate 16, as by bolts and nuts or by studs and nuts. The engine 13 includes a lubricating system including an oil sump, indicated generally by the reference numeral 46 that is affixed to the lower side of the spacer plate 16 and depending into the upper end of the drive shaft housing 15. Because the oil sump 46 is positioned within the drive shaft housing 15, it is possible to mount the engine 13 lower than if the sump were positioned above the spacer plate 16 and thus a relatively compact low center of gravity motor 11 is provided. In addition, this location of the oil sump 46 permits it to be of a larger capacity than if it were contained within the power head 12. The oil sump 46 is bolted to the spacer plate 16 in such a manner that the engine 13 may be removed from the spacer plate 16 for servicing without removal of the oil sump 46.

In addition to the oil sump 46, the lubricating system includes an oil pump, indicated generally by the reference numeral 47, which includes an impeller or pumping element that is driven off the lower end of the camshaft 37. Pressurized oil is delivered from the oil pump 47 through an oil delivery passage 48 that extends through the cylinder head 35, cylinder block 25 and which terminates at an end 49 in communication with the crankshaft lower bearing. The crankshaft is cross drilled, as indicated by the lines 51 so as to deliver oil to the connecting rod journals and also to an upper bearing of the crankshaft between the cylinder block 25 and crankcase 31. The upper crankshaft cross drilling communicates with a further oil delivery passage 52 that extends through the cylinder block 25 and cylinder head 35 so as to lubricate the upper journal of the camshaft 37. Oil may flow downwardly from this journal to lubricate the cam lobes 41, 42 and remaining components of the valve train.

Oil is drawn from the oil sump 46 by the oil pump 47 through an oil delivery pipe 53 that depends into the oil sump 46 and which terminates adjacent its lower end. An oil drain plug 54 is positioned in the oil sump 46 at this location. The oil delivery line 53 communicates with internal oil passages 55 formed in the cylinder block 25 and cylinder head 35 and which extends to the inlet side of the oil pump 47.

The lower face of the cylinder block 25 is formed with an oil return cavity 56 which is sealingly engaged with the upper face of the spacer plate 16. Oil is returned to this cavity from the crankcase 32 through an oil return opening 57 and from the camshaft chamber 38 through an oil return passage 58. Hence, the lubricating oil from the engine will be returned to the oil return cavity 56 through the passages 57 and 58. This oil is, in turn, returned to the oil sump 46 through an oil return opening 59 that is formed in the spacer plate 16 in a location and of a size now to be specifically described.

As is well known, outboard motors are frequently tilted up when not in use. Furthermore, such motors are frequently carried or are laid on their sides or edges when not attached to a watercraft. When so carried or laid, the motor is disposed with the axis of the crankshaft 29 and/or drive shaft 18 extending in a substantially horizontal direction. When the motor is so oriented with prior art type of constructions, it is possible for oil to return from the oil sump back into either the crankcase chamber, the camshaft chamber, or both. This oil that is returned to the engine in large quantities may seep past the valves and/or pistons into the combustion chambers. This can cause damage upon restarting and furthermore could cause oil to leak through the exhaust valves into the surrounding atmosphere and thus cause pollution. In accordance with this invention, the oil return opening 59 is positioned so that this drainback condition cannot occur.

Referring specifically to FIGS. 2 and 3, the oil level in the sump 46 when operating with the motor in a normal condition is shown by the solid line 61. The broken line 61A in FIG. 2 illustrates the position that this volume of oil will take when the motor 11 is placed with its forward edge on the ground so that the crankshaft 29 and drive shaft 18 extend generally horizontally and are positioned at the lower side of the engine. The broken line 61B in FIG. 2 indicates the oil level taken by this volume of lubricant if the engine is laid on its rear edge with the crankshaft 29 and drive shaft 18 extending horizontally and positioned at the upper side of the motor 11. In FIG. 3, the broken line 61C indicates the level of the volume of oil if the motor 11 is laid on one side and the broken line 61D indicates the oil level if the motor 11 is laid on its other side. From FIGS. 2 and 3 and considering the lines 61A, 61B, 61C and 61D, it will be seen that the oil lever never reaches the return opening 59 regardless of the orientation of the motor 11 so that the oil can never flow back through the opening 59 into the engine.

An oil dip stick 62 is provided in the engine for checking the level of the oil in a known manner.

It should be readily apparent from the foregoing description that the construction of the engine and specifically the sizing and locating of the oil drain hole 59 and its relation to the sump 46 and the volume and shape of the sump 46 is such that oil cannot return to the engine from the sump 46 when the engine is displaced from its normal condition with the crankshaft and drive shaft extending vertically. Although an embodiment of the invention has been illustrated and described, it is believed to be readily apparent that various changes and modifications may be made, without departing from the spirit and scope of the invention, as defined by the appended claims.

I claim:

1. In an outboard motor having a power head containing an internal combustion engine, a drive shaft housing depending from said power head and having an outer wall defining a cavity, a lower unit carrying propulsion means driven by a drive shaft extending through said drive shaft housing and driven by said engine, said lower unit being positioned beneath said drive shaft housing, an oil sump positioned entirely within said drive shaft housing cavity, and a drain opening communicating said engine with said oil sump for returning of lubricant from said engine to said sump, said drain opening being sized and located to prevent the normal oil level in said sump to extend to said drain opening when the outboard motor is laid in a generally horizontal direction to prevent the return of oil from said sump to said engine through said drain opening.

2. In an outboard motor as set forth in claim 1 wherein the normal oil level in the sump does not extend to the drain opening regardless of which side or end of the engine is laid in the generally horizontal direction.

3. In an outboard motor as set forth in claim 1 wherein there is a spacer plate in which the drain opening is formed and interposed between the power head and the drive shaft housing, the engine being supported above the spacer plate and the oil sump being supported below the spacer plate.

4. In an outboard motor as set forth in claim 3 wherein the engine has a crankcase and a cylinder head defining a camshaft chamber, a lower face of said engine defining an oil return cavity and further including oil drain passages extending from a lower portion of said crankcase and from a lower portion of said camshaft chamber to said oil return cavity, said drain opening being in communication with said oil return cavity, said oil sump being located between said crankcase and said camshaft chamber in a horizontal direction.

5. In an outboard motor having a power head containing an internal combustion engine, a drive shaft housing depending from said power head and having an outer wall defining a cavity, a lower unit carrying propulsion means driven by a drive shaft extending through said drive shaft housing and driven by said engine, said lower unit being positioned beneath said drive shaft housing, an oil sump positioned entirely within said drive shaft housing cavity, said oil sump having a substantially greater depth than width, and a drain opening communicating said engine with said oil sump for returning of lubricant from said engine to said sump, said drain opening being sized and located to prevent the return of oil from said sump to said engine through said drain opening when said motor is laid in a generally horizontal direction.

6. In an outboard motor having a power head containing an internal combustion engine, a drive shaft housing depending from said power head and containing a drive shaft extending about a generally vertically extending axis when said motor is in its normal position, said engine having a crankshaft contained within a crankcase and driving said drive shaft, an oil sump positioned beneath said engine, and a drain opening communicating said engine with said oil sump for return of lubricant from said engine to said oil sump, the improvement comprising said oil sump being offset from said drive shaft with said drive shaft being spaced to one side of said oil sump, said drain opening being sized and located to prevent the return of oil from said oil sump to said engine through said drain opening when said motor is laid with its drive shaft in a generally horizontal direction.

7. In an outboard motor as set forth in claim 6 wherein the oil sump and drain opening are configured so that the normal oil level in the sump does not extend to the drain opening when the engine is laid in a generally horizontal direction.

8. In an outboard motor as set forth in claim 7 wherein the normal oil level in the sump does not extend to the drain opening regardless of which side or end of the engine is laid in the generally horizontal direction.

9. In an outboard motor as set forth in claim 7 wherein there is a spacer plate in which the drain opening is formed, the engine being supported above the spacer plate and the oil sump being supported below the spacer plate, the motor further including a drive shaft housing positioned beneath the power head, the spacer plate dividing the power head from the drive shaft housing so that said oil sump depends into said drive shaft housing.

10. In an outboard motor as set forth in claim 9 wherein the engine has a crankcase and a cylinder head defining a camshaft chamber, a lower face of said engine defining an oil return cavity between said crankcase and said camshaft chamber and further including oil drain passages extending from a lower portion of said crankcase and from a lower portion of said camshaft chamber to said oil return cavity, said drain opening being in communication with said oil return cavity.

11. An internal combustion engine having a crankshaft supported for rotation about a vertically extending axis within a crankcase, an oil sump positioned beneath said engine and offset from one side of said crankcase and said crankshaft with the axis of rotation of said crankshaft not passing within the area bounded by said oil sump, and a drain opening communicating said engine with said oil sump for return of lubricant from said engine to said oil sump, said drain opening being sized and located to prevent the return of oil from said sump to said engine through said drain opening when said engine is laid with its crankshaft in a generally horizontally extending axis.

12. In an internal combustion engine as set forth in claim 11 wherein the oil sump and drain opening are configured so that the normal oil level in the sump does not extend to the drain opening when the engine is laid in a generally horizontal direction.

13. In an internal combustion engine as set forth in claim 12 wherein the normal oil level in the sump does not extend to the drain opening regardless of which side or end of the engine is laid in the generally horizontal direction.

14. In an internal combustion engine as set forth in claim 12 wherein there is a spacer plate in which the drain opening is formed, the engine being supported above the spacer plate.

15. In an internal combustion engine as set forth in claim 11 wherein the engine has a cylinder head defining a camshaft chamber, a lower face of said engine defining an oil return cavity and further including oil drain passages extending from a lower portion of said crankcase and from a lower portion of said camshaft chamber to said oil return cavity, said drain opening being in communication with said oil return cavity.

16. In an internal combustion engine as set forth in claim 11 wherein the oil sump has a substantially greater depth than width.

17. In an outboard motor as set forth in claim 6 wherein the oil sump has a substantially greater depth than width.

* * * * *